US012232519B2

(12) United States Patent
Archambault et al.

(10) Patent No.: US 12,232,519 B2
(45) Date of Patent: Feb. 25, 2025

(54) CANNABIS OIL INJECTOR AND CANNABIS JOINTS MANUFACTURING MACHINE THEREWITH

(71) Applicant: Le Groupe Solid Packaging Robotik Inc., Terrebonne (CA)

(72) Inventors: Robert Archambault, Boisbriand (CA); Daniel Martel, Terrebonne (CA); Harold Bouchard, Bois-des-Filion (CA)

(73) Assignee: Le Groupe Solid Packaging Robotik Inc., Terrebonne (CA)

( * ) Notice: Subject to any disclaimer, the term of this patent is extended or adjusted under 35 U.S.C. 154(b) by 459 days.

(21) Appl. No.: 17/827,893

(22) Filed: May 30, 2022

(65) Prior Publication Data

US 2023/0380480 A1 Nov. 30, 2023

(51) Int. Cl.

| | |
|---|---|
| ***A24C 5/60*** | (2006.01) |
| ***A24C 5/00*** | (2020.01) |
| ***A24C 5/02*** | (2006.01) |
| ***A24C 5/12*** | (2006.01) |
| ***A24C 5/32*** | (2006.01) |
| ***A24C 5/34*** | (2006.01) |
| ***A24C 5/39*** | (2006.01) |
| ***A24C 5/54*** | (2006.01) |
| ***A24D 1/00*** | (2020.01) |
| ***A24D 1/18*** | (2006.01) |

(52) U.S. Cl.

CPC ..... *A24C 5/608* (2013.01); *A24C 5/002* (2013.01); *A24C 5/02* (2013.01); *A24C 5/12* (2013.01); *A24C 5/322* (2013.01); *A24C 5/3424* (2013.01); *A24C 5/397* (2013.01); *A24C 5/54* (2013.01); *A24D 1/002* (2013.01); *A24D 1/18* (2013.01)

(58) Field of Classification Search

CPC ..... A24C 5/02; A24C 5/322; A24C 5/397; A24C 5/54; A24C 5/608

See application file for complete search history.

(56) References Cited

U.S. PATENT DOCUMENTS

| | | | |
|---|---|---|---|
| 9,549,571 | B2 | 1/2017 | Magne |
| 2017/0121169 | A1 | 5/2017 | Dailey et al. |
| 2020/0010283 | A1 | 1/2020 | Holderman et al. |
| 2021/0267265 | A1 | 9/2021 | Partansky et al. |

FOREIGN PATENT DOCUMENTS

| | | |
|---|---|---|
| EP | 23174971.4 | 1/2024 |
| EP | 23208654.6 | 3/2024 |
| GB | 2590639 A | 7/2021 |
| WO | WO 2020077455 A1 | 4/2020 |

*Primary Examiner* — Eric Yaary

(74) *Attorney, Agent, or Firm* — Agence de Brevets Fournier

(57) ABSTRACT

A cannabis joints manufacturing machine comprises a plurality of different cannabis joints manufacturing stations, each for performing on one cannabis cone at a time a step among a sequence of steps for manufacturing a cannabis joint; one of the cannabis joints manufacturing stations including a cannabis oil injector; the plurality of different cannabis joints manufacturing stations being positioned side-by-side according to the sequence of steps for manufacturing a cannabis joint; and a cannabis cone support for receiving a plurality of cannabis cones and for sequentially moving together the plurality of cannabis cones between each of the plurality of different cannabis joints manufacturing stations.

37 Claims, 11 Drawing Sheets

CANNABIS OIL INJECTOR AND CANNABIS JOINTS MANUFACTURING MACHINE THEREWITH

FIELD

The present disclosure generally relates to cannabis joints and more specifically to cannabis joint forming machines.

BACKGROUND

Cannabis joints have long been and are still very often prepared by hand.

However, the legalization of cannabis in many territories have seen the coming of the automatization in the manufacturing of cannabis joints.

Some of the automated processes in the manufacturing of cannabis joints involve inserting paper cones in a cone holding tray and then vibrating the whole tray while it receives cannabis in bulk, the vibrations aiming at evening out the filling of the cones.

A drawback of such vibrating tray is that strong and moderate vibrations have been found to separate the delta-9-tetrahydrocannabinol (THC) from cannabis, thereby decreasing the quality of the product.

Other known processes for manufacturing cannabis joints include moving together in parallel a series of cannabis cones between different stations, each performing a further step towards manufacturing the joints.

A problem with such parallel processing is that it involves at some point literally injecting cannabis in each cone and then compacting the cannabis.

Drawbacks of such cannabis injection include separation of THC as described hereinabove and the lack of uniformity along the length of the cone considering its shape.

Another drawback is that it renders tedious the quality control on each joint, considering that a plurality of cannabis joints is finished at a same time.

Also, the machines used to process many cannabis joints in parallel are bulky.

SUMMARY

According to an illustrative embodiment, there is provided a cannabis joints manufacturing machine comprising:

plurality of different cannabis joints manufacturing stations, each for performing on one a cannabis cone at a time a step among a sequence of steps for manufacturing a cannabis joint; one of the cannabis joints manufacturing stations including a cannabis oil injector; the plurality of different cannabis joints manufacturing stations being positioned side-by-side according to the sequence of steps for manufacturing a cannabis joint; and a cannabis cone support for receiving a plurality of cannabis cones and for sequentially moving together the plurality of cannabis cones between each of the plurality of different cannabis joints manufacturing stations.

According to another illustrative embodiment, there is provided a system for injecting cannabis oil in a cannabis joint, the system comprising:

a syringe provided with an injection needle;

a cannabis oil reservoir that is connected to the syringe and that is configured to feed a predetermined single dose of cannabis oil thereto;

a cannabis joint holder for receiving a cannabis joint;

a gripper i) for taking the cannabis joint when it is received in the cannabis joint holder, ii) for moving the cannabis joint so that it is penetrated by the injection needle, and iii) for moving back the cannabis joint into the cannabis joint holder.

According to still another illustrative embodiment, there is provided a process for manufacturing cannabis joints, the process comprising:

providing a plurality of different cannabis joint manufacturing stations, each for performing on one cannabis cone at a time a step among a sequence of steps for manufacturing a cannabis joint; one of the cannabis joints manufacturing stations including a cannabis oil injector; the plurality of different cannabis joints manufacturing stations being positioned side-by-side according to the sequence of steps for manufacturing a cannabis joints; and moving together sequentially a plurality of cannabis cones between each of the plurality of different cannabis joints manufacturing stations so that the steps for manufacturing a cannabis joints are performed sequentially on each of the plurality of cannabis cone.

According to yet another illustrative embodiment, there is provided a process for manufacturing cannabis joints, the process comprising:

providing a carrousel having a plurality of sectors and a plurality of paper cone holders, one in each of the plurality of sectors;

providing a series of processing stations positioned around the carrousel, each of the processing stations corresponding to a distinct step among a sequence of steps for manufacturing a cannabis joint;

performing the sequence of steps for each of the plurality of paper cone holders after rotating the carrousel to move the plurality of paper cone holders along the series of processing stations positioned around the carrousel.

It is to be noted that the term 'station' is to be construed herein as including any system, apparatus, machine or device that performs a specific task or step among a plurality of such tasks or steps required to achieve a result.

Other objects, advantages, and features of the cannabis joints manufacturing machine and process and of a system for injecting cannabis oil in a cannabis joint will become more apparent upon reading the following non-restrictive description of illustrative embodiments thereof, given by way of example only with reference to the accompanying drawings.

BRIEF DESCRIPTION OF THE DRAWINGS

In the appended drawings:

FIGS. 3A to 3G are perspective views of a system for injecting cannabis oil in a cannabis joint, part of the machine from FIG. 1;

DETAILED DESCRIPTION

Figure 1:
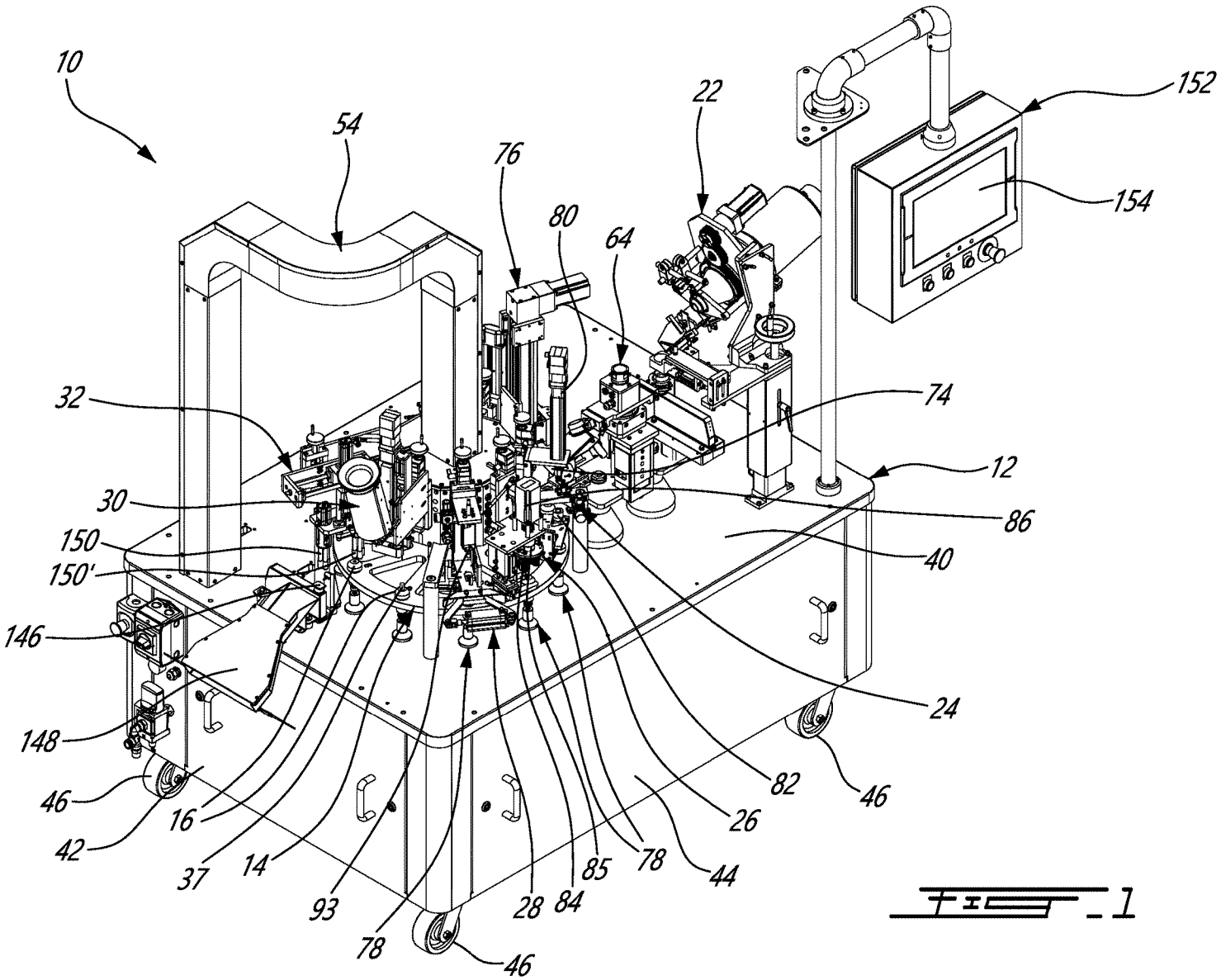
FIG. 1 is a perspective view of a cannabis joint manufacturing machine according to a first illustrative embodiment.

In the following description, similar features in the drawings have been given similar reference numerals, and in order not to weigh down the figures, some elements are not referred to in some figures if they were already identified in a precedent figure. Herein, it shall further be noted that, for avoiding unnecessary details obscuring the invention, only device structures and/or processing steps closely relevant to schemes according to the invention are shown in the accompanying drawings while omitting other details less relevant to the invention.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, un-recited elements.

Figure 2:
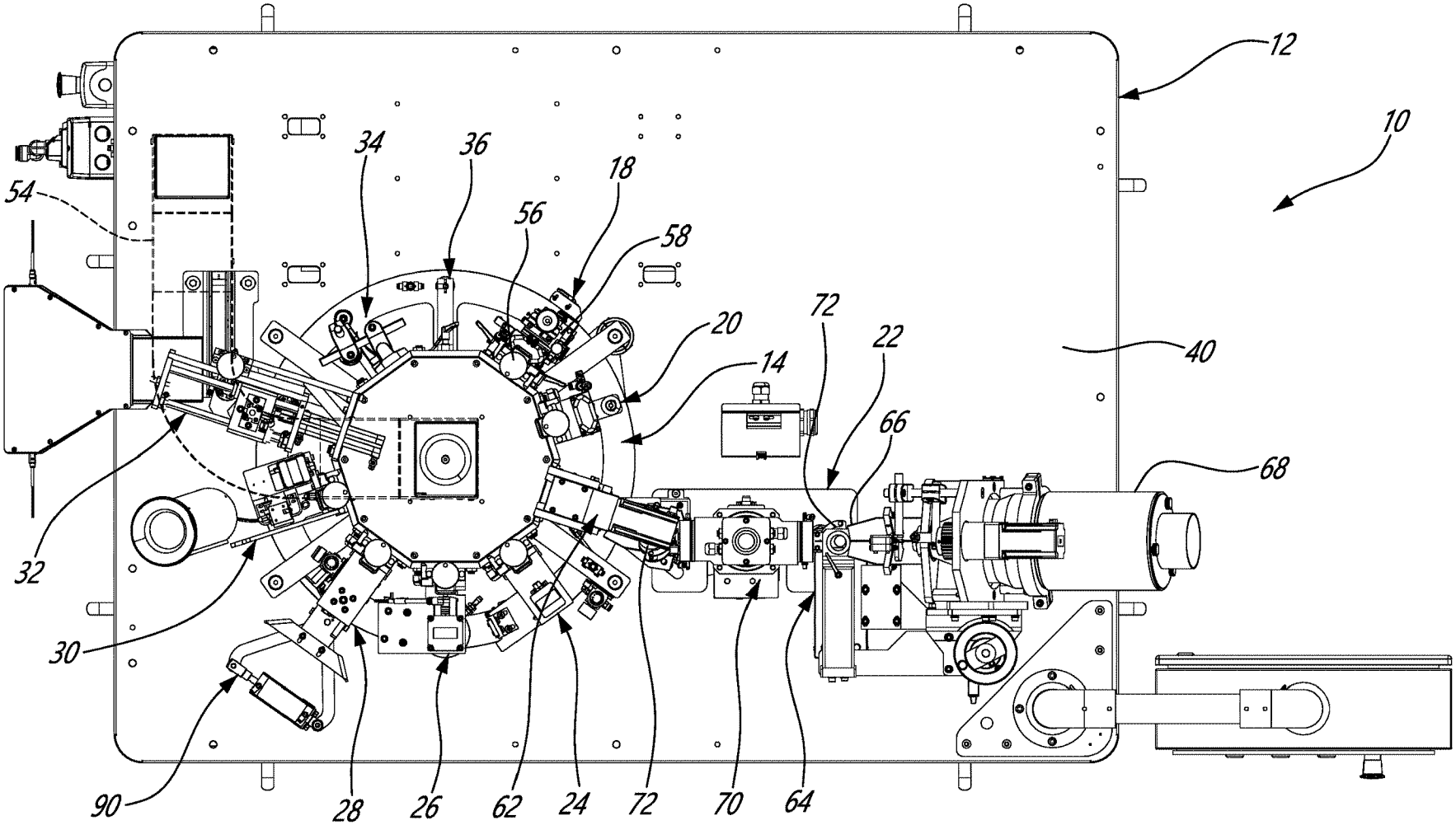
FIG. 2 is a top plan view of the machine from FIG. 1.

A machine 10 for manufacturing cannabis joints according to an illustrative embodiment will now be described with reference first to FIGS. 1 and 2.

Figure 4A:
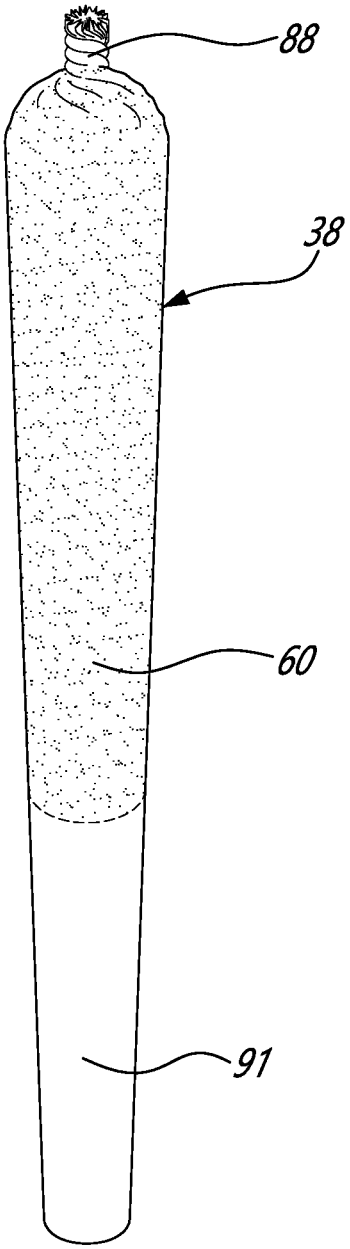
FIGS. 4A and 4B are perspective views of cannabis joints made using the machine from FIG. 1, according to first and second illustrative embodiments respectively.

The machine 10 comprises a supporting structure in the form of a table 12, a motorized carrousel 14 that is rotatably mounted to the table 12 and that receives a plurality of cannabis cone holders 16 (only two visible), and a plurality of different cannabis joints manufacturing stations 14-36 mounted to the table 12, each for performing, on one cannabis cone 37 at a time, a step among a sequence of steps for manufacturing a cannabis joint 38 (see on FIG. 4A).

The table 12 comprises a generally rectangular top surface 40, supported by a frame (not shown), removable side panels 42 and 44 secured to the frame and defining a box-shaped with the top surface 40. The frame is mounted to wheels 46 (only three (3) shown), allowing to easily move the machine 10.

As will become more apparent upon reading the following description, the configuration of the cannabis joints manufacturing stations 14-36 above and around the carrousel gives the machine 10 a compact configuration. According to the first illustrative embodiment, the machine 10 is about 1.25 m×1.70 m×2.08 m.

The carrousel 14 is rotatably secured to the table 12 via an electric motor (not shown) or another rotary actuator. Since such a carrousel is believed to be well known in the art, it will not be described herein in more detail for convenience purposes.

The paper cone holder 16 are in the form of elongated bodies having a frusto-conical bore (not shown) therein that is configured and sized to complementary receive a paper cone 37 therein in a snugly fit manner in view of preventing the deformation and breakage of the cone 37 therein during operation of the machine 10.

Figure 3A:
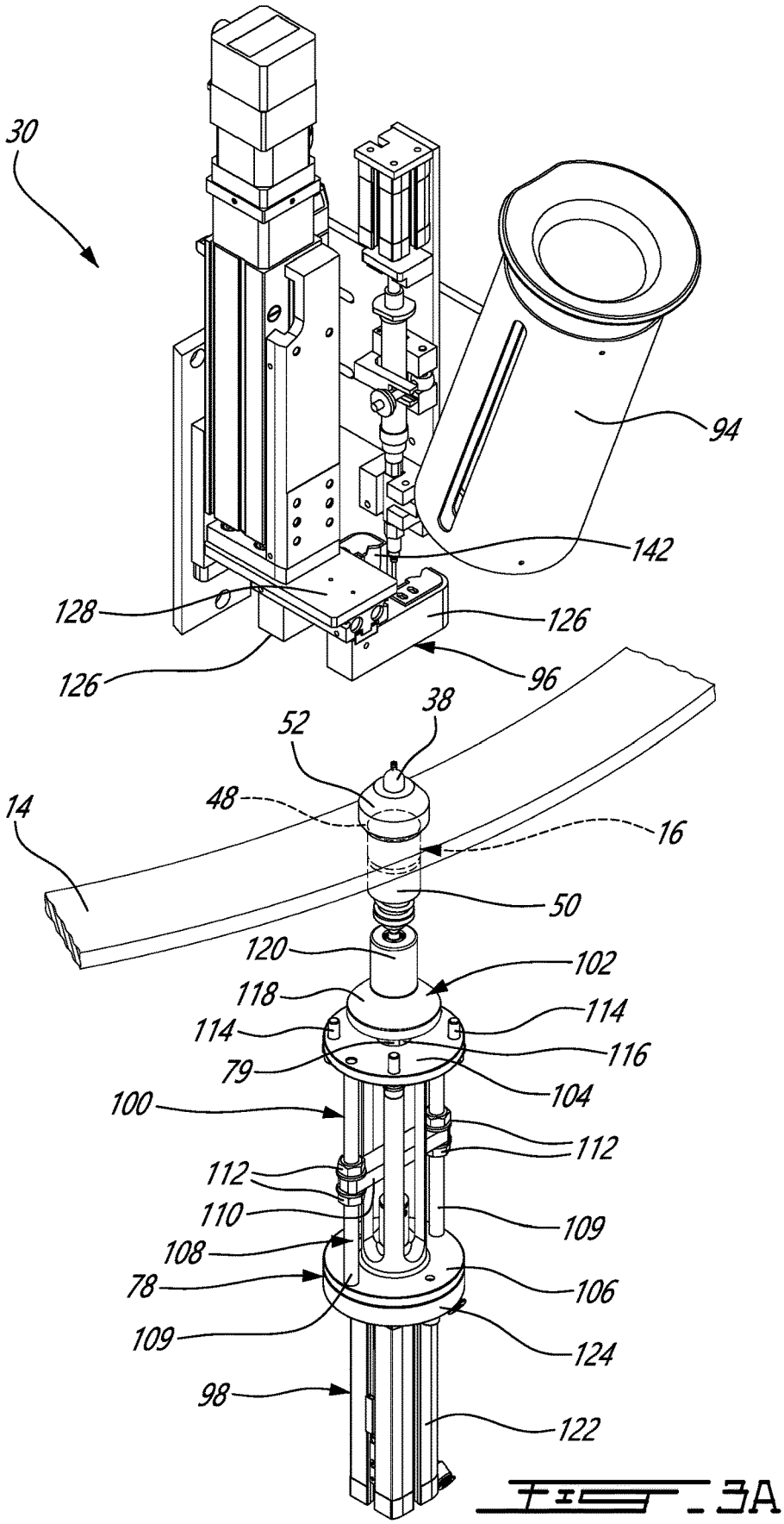
Figure 3B:
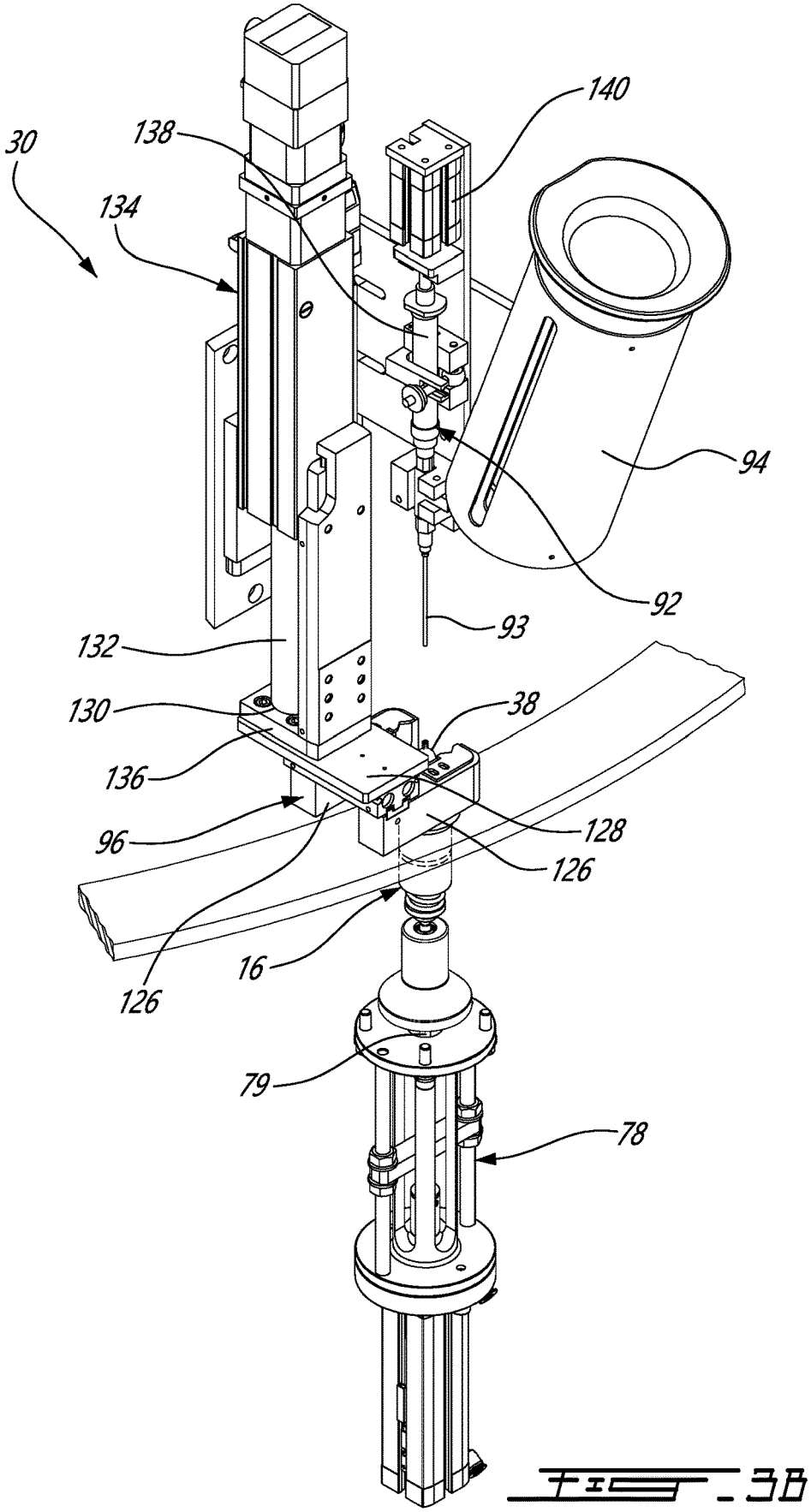
Figure 3C:
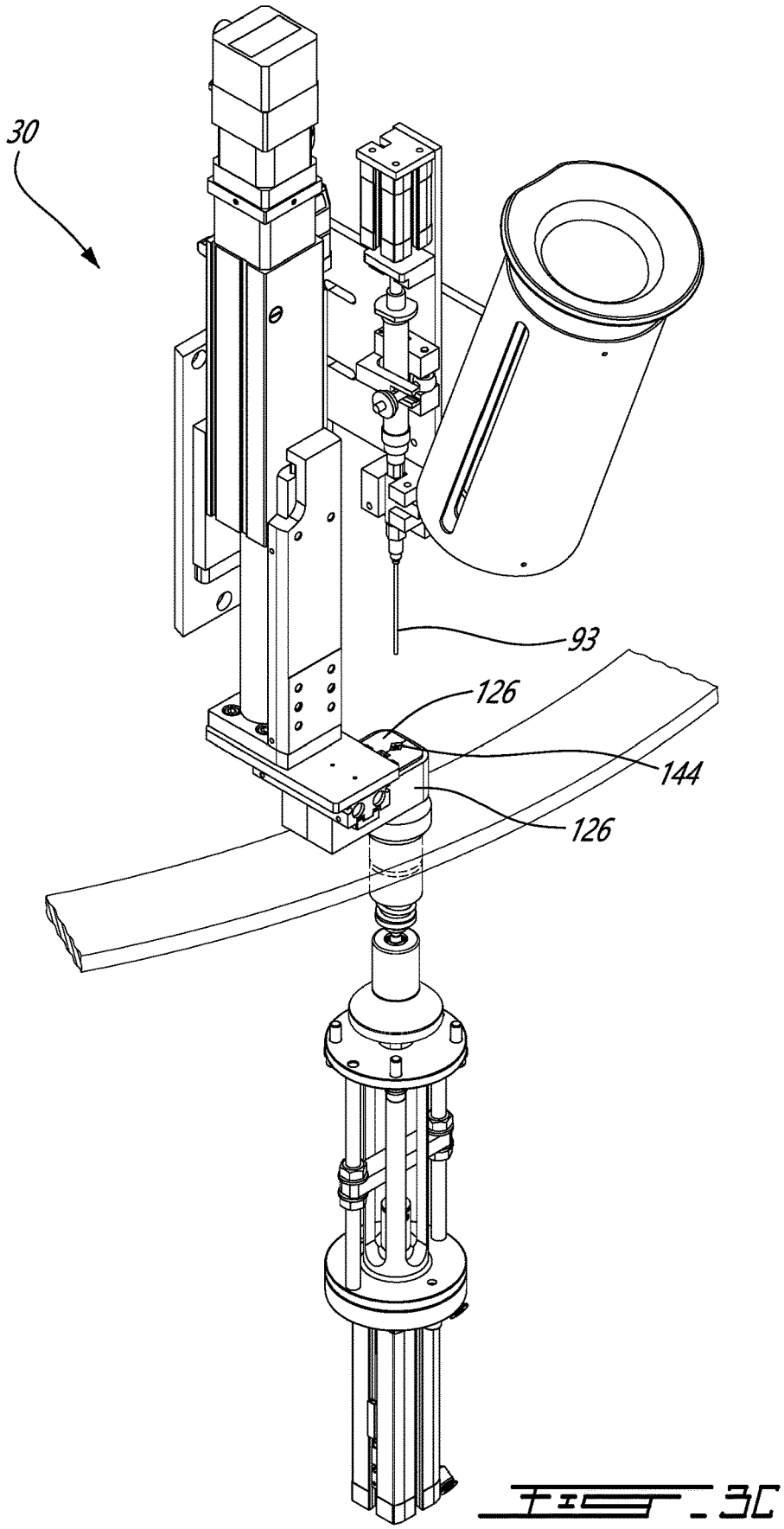
Figure 30:
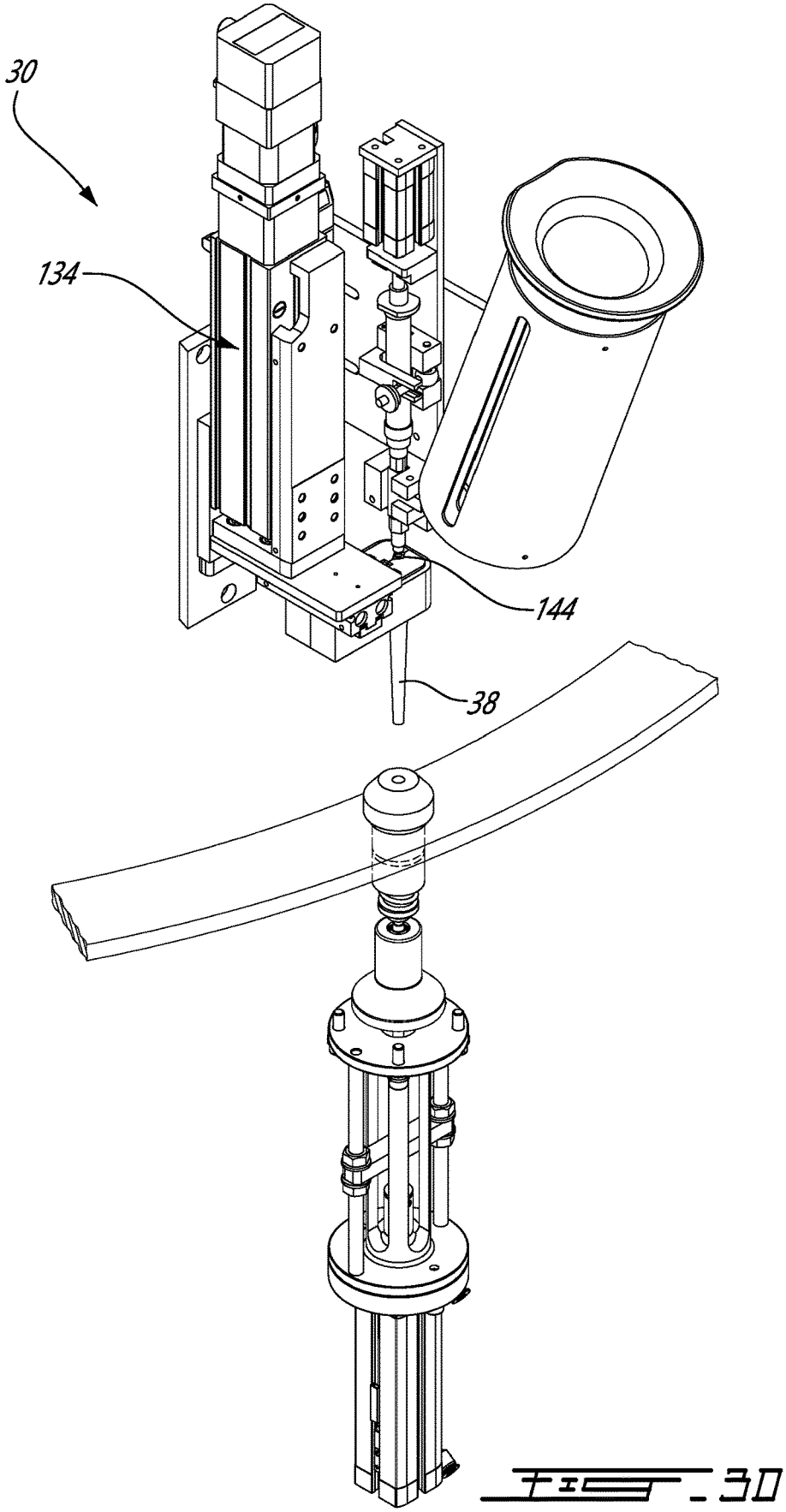

With reference briefly to FIG. 3B, the paper cone holders 16 are freely mounted in corresponding circular holes 48 in the carrousel 14. For that purpose, each holder 16 includes a narrow section 50 and a wider top portion 52. While the narrow section 50 has a diameter that is configured for smooth translation in and out of a corresponding opening 48, the top portion 52 defines a stopper for stably seating each holder 16 in the opening 48.

As will be described hereinbelow in more detail, the carrousel 14 is provided to facilitate the sequential and consecutive filling of a plurality of paper cones 37, while yielding a compact machine 10.

According to the illustrated embodiment, the carrousel 14 includes ten (10) holders 16, which allows potentially processing ten (10) paper cones 37 at a same time, each one being processed by a different station 14-36. However, as will become more apparent upon reading the following description, the machine 10 processes eight (8) cones simultaneously, two of the stations 14-36 being dedicated to cleaning the holders 16.

The components of the different stations 18-36 are mounted directly to the table 12 and/or suspended above the carrousel 14 via a holder arm 54. The arm 54 further acts as a guide for cables and pipes.

Figure 5:
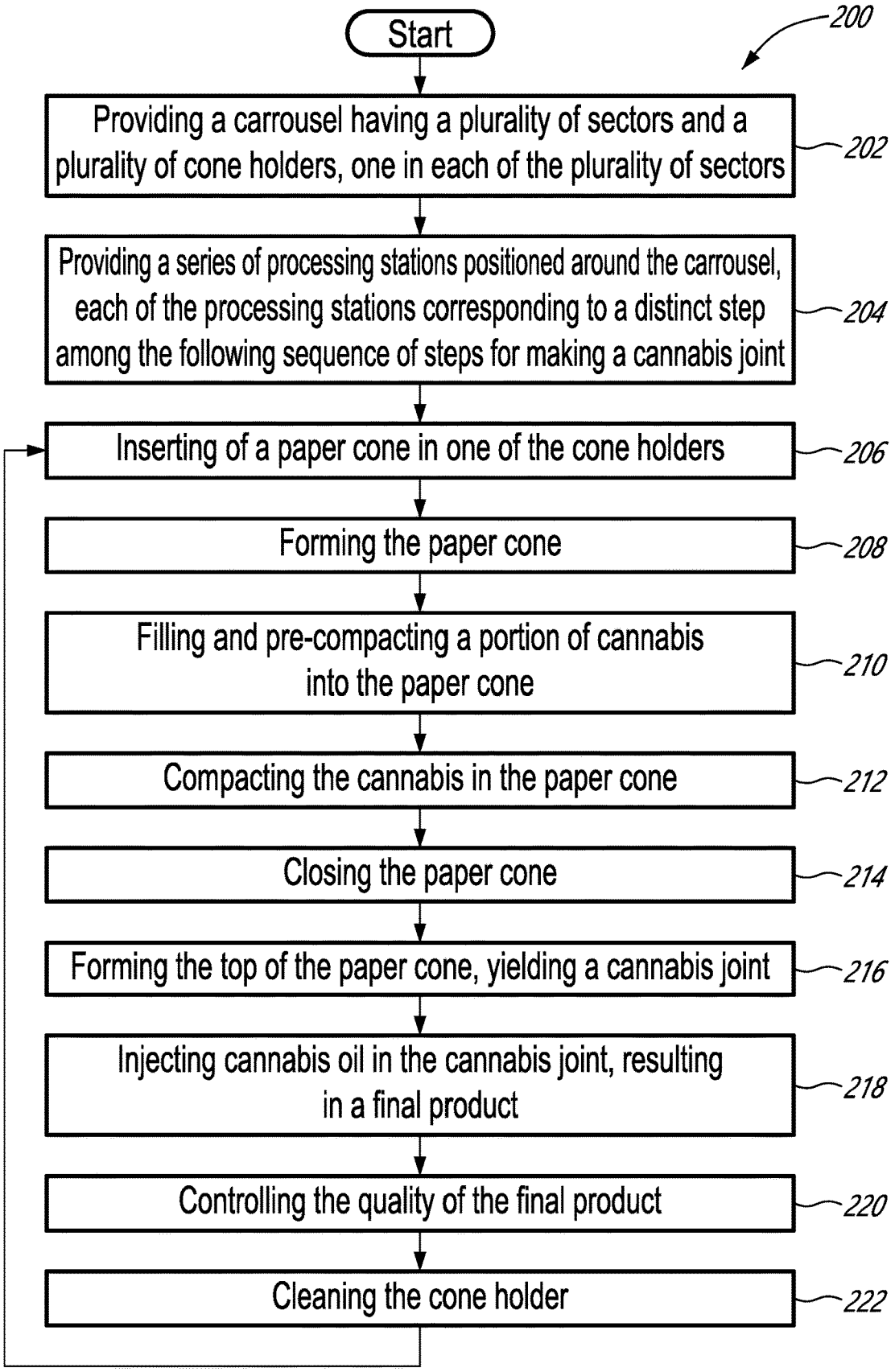
FIG. 5 is a flowchart illustrating a process for manufacturing cannabis joints according to an illustrative embodiment.

The machine 10 comprises the following stations laid-out in a circle around the carrousel 14 so as to process the corresponding steps sequentially in an infinite loop manner, as illustrated in FIG. 5, which summarizes a process 200 for manufacturing cannabis joints 38:

- a paper cone distributor 18, which feeds paper cones 37 to the cone holders 16;
- a cone positioner 20;
- a cannabis filling system 22;
- a cannabis compactor 24;
- a cannabis joint closure system 26;
- a cannabis joint end former 28;
- a system for injecting cannabis oil 30;
- a quality control and sorting system 32;
- damaged cone ejector 34; and
- cone holder cleaning system and 36.

It is to be noted that the expression cone and joint are used herein to refer to the same product, but during different phase of its manufacture. More specifically, the expression "cone" will be generally used herein to refer to the product until the paper cone is closed. At that point, the product will be referred to as a 'joint'. This terminology should however not be used in any restraining way.

The first step 206 in manufacturing cannabis joints 38 is the insertion of a cannabis cone 37 in one of the cone holders 16.

The paper cone 37, also referred to herein as cannabis cone, is made, for example, of paper derived from hemp or palm leaves, but can alternatively be made of another material.

Also, the term 'cone' is used in a non-limitative way and the paper support used in manufacturing the joint may have another shape than conical.

The paper cone distributor 18 includes a pick and place robot (not shown) that receives a plurality of stacked paper cones 37, a cylindrical chute 56 and a cone indexer 58 for picking a single blank paper cone 37 in the stack (not shown) and for releasing it in the cylindrical chute 56. The carrousel 14 is positioned so that a holder 16 is precisely registered with the cylindrical chute 56 when the paper cone 16 is dropped therein. The distributor 18 is provided with at least one sensor to detect a paper cone 37 for picking and/or for determining whether a single cone 37 is inserted in the corresponding holder 16.

The paper cone distributor 18 is not limited to the illustrative embodiment and may include different supports and mechanisms than those illustrated to store paper cones 37 and insert them in a paper cone holder 16, one at a time.

The carrousel 14 is then rotated 36 degrees to the next step (step 208), wherein the paper cone 16 is formed. For that purpose, the cone positioner 20 includes a plunger (not shown) which both completely inserts the cone 37 in its holder 16 and position the cone 37 in a fully opened configuration.

According to another illustrative embodiment (not shown), the cone former includes an elongated body that is shaped complementary to the paper cone 37, so that, when inserted in the paper cone 37, forces the cone 37 in a fully opened configuration.

At this point it is important to note that, according to the first illustrative embodiment of the machine 10 and process 200, all the stations 18-36 operate at the same time until the longer processing step is finished, following which the carrousel 14 is then rotated another 36 degrees.

The next step (step 210) corresponds to the filling of a portion of cannabis 60 into the until then empty cone 37.

The portion of cannabis 60 will also be referred to as a single dose of cannabis and is a predetermined quantity of cannabis provided to form a joint (not shown) with the paper cone 37. Of course, such a single dose 60 may vary depending, for example, on the size of the paper cone 37 to fill. The machine 10 and its operation can be adapted for such variations.

The cannabis filling system 22 comprises a paper cone filling apparatus 62 for receiving and pre-compacting the single portion of cannabis in the paper cone 37 that is in the registered holder 16, and a cannabis feeding system 64 for feeding the predetermined portion of cannabis to the paper cone filling apparatus 62.

The cannabis feeding system 64 comprises i) an electronic weighing scale 66, ii) a cannabis feeding apparatus 68, adjacent the weighing scale 66, for receiving cannabis in bulk (not shown) and for controllably outputting the cannabis onto the weighing scale 66, and iii) a single portion cannabis distributing device 70 including two cups 72 that are sequentially movable between a cannabis weighing position, wherein one of the two cups 72 cooperates with the weighing scale 66 to measure the predetermined portion of the cannabis, and a cannabis distributing position, where the predetermined portion of the cannabis is fed to the paper cone filling apparatus 62.

The apparatus 62 comprises a funnel 74, positioned adjacent the single portion cannabis distributing device 64 and registered with a corresponding holder 16, for receiving the single dose of cannabis therefrom, for receiving and holding a paper cone 14 therein, a pusher mechanism (not shown) for positioning the paper cone holder 16 in abutment with the funnel 74 so as to be in fluid communication therewith and a reciprocating needle mechanism 76 that includes a needle (not visible) that is movable in the paper cone holder 16 to reciprocate therein while being moved out of the paper cone 37 in the holder 16 so as to pre-compact the cannabis while it is filled therein.

The cannabis filling system 22 is not limited to the illustrated embodiment and other paper cone filling apparatus and cannabis feeding system can be provided.

The carrousel 14 is then rotated 36 degrees to the next step (step 212) so as to be registered with the cannabis compactor 24, wherein the filled and pre-compacted cannabis cone 37 is compacted.

According to the first illustrative embodiment, the cannabis compactor 24 comprises an inverted funnel (not shown) positioned along an axis that is coaxial the holder 16 at a distance therefrom, a cone-rising mechanism 78 for moving the cannabis cone 37 through the inverted funnel up to a second position along the axis, a cone gripper (not shown) under the funnel that is movable between an open position and a closed position around the cannabis cone 37 at the second position, a cannabis compaction mechanism 80, including a rod (not shown) that is reciprocable along the axis, for compacting the cannabis 60 in the cannabis cone 37, and an expandable collar 82 that is movable by the compaction rod to form a barrier between the compaction rod and the cannabis cone 37 when the compaction rod reciprocates in the cannabis cone 37.

The cone-rising mechanism 78 includes a pusher rod 79 that is selectively movable towards the holder 16 to push the holder 16 partly out of its hole 48.

The cannabis compactor 24 is not limited to the illustrated embodiment and any other system suitable to compact the cannabis 60 in the cone 37 can be provided.

Once the cannabis cone 37 is back in its holder 16, the carrousel 14 is once again rotated, moving the cannabis cone 37 to the cannabis joint closure system 26, where the open end of the cone 37 with cannabis 60 inside is closed (step 214).

The cannabis joint closure system 26 comprises a cone-rising mechanism 78, for moving the cone 37 partly out of the holder 16, a joint grabber (not shown) to hold the cone 37, and a rotary gripper 84, that is provided with a pair of movable claws 85, and that is coupled to a servomotor 86 that selectively causes the pair of claws 85 to close onto the top portion of the paper cone 37 that is free of cannabis while the remaining part of the cone is held by the grabber, and to rotate the top portion to form a twisted tip 88 therewith.

It is to be noted that the cannabis joint closure system 26 is not limited to the illustrated embodiment and can take other forms causing the top portion of the cone 37 that is free of cannabis 60 to be closed.

Once the cannabis cone 37 is released back to its holder 16 by the gripper 84, the carrousel 14 is rotated another 36 degrees to move the cone holder 16 with the cannabis cone 37 therein to the cannabis joint end former 28 where the tip 88 of the joint is further formed (step 216)

According to the first illustrative embodiment, the joint end former 28 comprises a cone-rising mechanism 78, for moving the cone 37 partly out of the holder 16, a gripper (not shown) to grab onto the cone 37, and a cutter 90, having a fixed part and a movable blade to cut a predetermined length of the tip 88, resulting in a fully formed cannabis joint 38, as shown in FIG. 4A.

As can be further seen in FIG. 4A, a filter 91, which is pre-inserted in the cannabis cone 37 prior to the manufacturing process 200, is provided at the end thereof opposite the tip 88, which prevents marijuana from falling therethrough during transport and handling, and that stops resin from clogging the end of the resulting joint 38. According to another illustrative embodiment (not shown), the cone 37 is not provided with a filter 91.

Figure 4B:
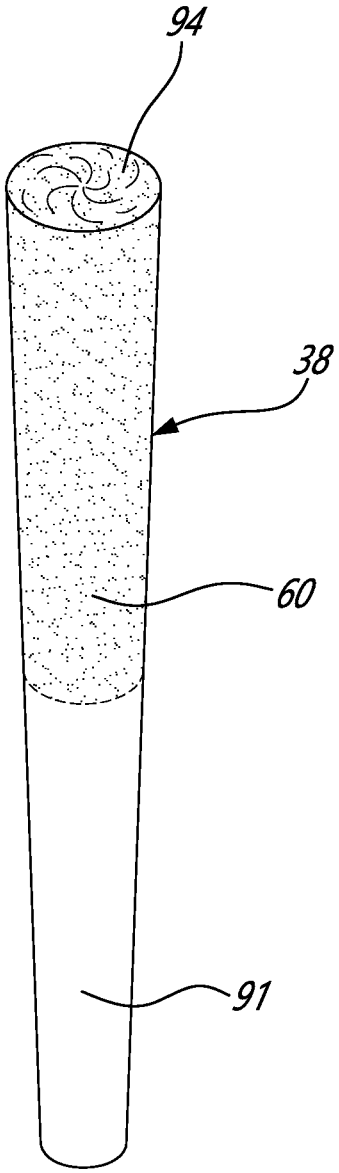

According to a more specific embodiment of the joint end former 28, it further includes a pusher rod 93 that is movable towards and away the joints 38, while it is still held by the gripper, to flatten the top of the joint, resulting in a flat-top joint 38', as shown in FIG. 4B.

It is to be noted that many of the above-described mechanism are made adjustable to as to allow creating joints 38 having different dimension, different quantity of cannabis 60, different compacting level, etc.

As a further example, the joint end former 28, and more specifically the displacement of the cone-rising mechanism 78, can be adjusted to yield a predetermined length of the tip 88.

Once the cannabis joint 38 is released back to its holder 16 by the gripper, the carrousel 14 is rotated another 36 degrees to move the cone holder 16 with the joint 38 therein to the cannabis oil injector 30, wherein a predetermined quantity of cannabis oil is injected in the joint 38 (step 218).

The cannabis oil injector 30 will now be described in more detail with reference first to FIGS. 3A and 3B.

It is to be noted that the expression "cannabis oil injector" and "system for injecting cannabis oil" will be used herein interchangeably.

The cannabis oil injector 30 comprises a syringe 92, a cannabis oil reservoir 94 that is operatively coupled to the syringe 92 and that is configured to feed a predetermined single dose of cannabis oil thereto, a cone-rising mechanism 78, for moving the cannabis joint 38 partly out of the holder 16, and a gripper 96 i) for taking the cannabis joint 38 when it is received in the cannabis joint holder 16, ii) for moving the cannabis joint 38 so that it is penetrated by the injection needle 93 of the syringe 92, and iii) for releasing the cannabis joint 38 into the cannabis joint holder 16.

The cone-rising mechanism 78 includes i) a linear actuator 98, having an output shaft (not shown), ii) a rod 79 secured to the output shaft at the free end thereof so as to define an extension thereof, iii) a rod course length adjusting assembly 100 for limiting the course of the shaft, and therefor of the rod 79, and iv) a rod-guiding sleeve 102 coupled to the course length adjusting assembly 100.

The rod course length adjusting assembly 100 includes top and bottom parallel mounting caps 104 and 106 that are assembled and distanced by a spacer frame 108, and a mechanical stop 110 that is adjustably mounted to both mounting caps 104-106 therebetween. More specifically, the mechanical stop 110 is mounted to the caps 104-106 via two threaded rods 109 that are fixedly mounted to both caps 104-106 therebetween on diametrically opposite locations.

The mechanical stop 110 is in the form of a narrow plate that includes a first central hole (not shown) to allow passage for the rod 79 for free reciprocal movement therethrough, and two mounting holes (not shown), each receiving a respective threaded rod 109 therein. A person skilled in the art will now appreciate that the above-described arrangement allows the slidable movement of the mechanical stop 110 between both caps 104-106 parallel thereto. A pair of nuts 112 is provided to secure the mechanical stop 110 on each threaded rod 109 at a selected position thereon. The spacer frame 108 is configured to allow the afore mentioned slidable movement of the mechanical stop 110.

The rod course length adjusting assembly 100 is secured to the table top 40 thereunder via its top cap 104 using fasteners 114. A hole (not shown) in the table top 40 allows passage for the rod 79 therethrough.

The rod-guiding sleeve 102 is in the form of a one-piece body having a bottom cylindrical portion 116 that is sized for snugly fit insertion in the table hole, an enlarged portion 118 that extends from the bottom cylindrical portion 116 and that defines a shoulder portion (not shown) therewith, and a top cylindrical portion 120 that extends from the enlarged portion 118 at a longitudinal side thereof opposite the bottom cylindrical portion 116. The top cylindrical portion 120 includes a housing at the distal end thereof, that receives a cylindrical guide, in the form of a bushing (not shown), and a seal (not shown) to prevent cannabis from entering the sleeve 102. The top cap 104 includes a hole (not shown) to receive the bottom cylindrical portion 116 of the sleeve 102 therein in a snugly fit manner. The rod guiding sleeve 102 includes a longitudinal bore to allow passage for the rod 79 though therethrough.

The main body 122 of the linear actuator 98 is secured to the bottom cap 106 thereunder via a mounting plate 124 using fasteners or other fastening means or a mounting assembly. The bottom cap 106 and mounting plate 124 are provided with respective registered holes to allow passage for the output shaft of the linear actuator 98 therethrough.

The rod 79 is secured to the output shaft by a conventional cylindrical coupler (not shown), which further acts as an impactor. For that reason, a rubber ring (not shown) or any similar damper is provided about the rod 79 onto the coupler.

In operation of the cone rising mechanism 78, the linear actuator 98 is actuated so that the rod 79 is moved upwardly towards the cone holder 16. This translation of the rod 79 is stopped when the impactor abuts the mechanical stop 110.

The mechanical stop 110 is so positioned that the movement of the rod 79 stops when the cannabis joint 38 is slided out a predetermined height from the cone holder 16. Of course, the cone rising mechanism 78 is positioned relative to the cone holder so that the rod 79 is substantially coaxial with the cone holder 16.

Also, another mechanism or assembly than the rod course length adjusting assembly 100 can be provided to adjust or limit the course of the rod 79. Such an adjustable mechanism can also be omitted in some embodiment.

The gripper 96 comprises a pair of claws 126 that are mounted to a mounting plate 128 for sliding movement towards and away each other via a motorized rack and pinion or another similar mechanism (not shown).

The mounting plate 128 is secured at the free end 130 of the sliding rod 132 of a linear actuator 134 via a mounting assembly 136. The gripper 96 is so positioned relative to the cone holder 16 that the claws 126 are registered with the cannabis joint 38 therein when they are in their closed position. The liner actuator 134 can then be operated to move the gripper 96 towards and away the cone holder 16.

The syringe 92 includes a plunger 138 that is operatively coupled to a linear actuator 140 for its actuation The operation of the cannabis oil injector 30 will now be described with references to FIGS. 3A-3G.

As can be seen in FIG. 3A, the cone rising mechanism 78 is first actuated so that the cannabis joints 38 is raised so as to be ready for grab by the gripper 96.

With reference to FIG. 3B, the linear actuator 134 is then operated to lower the claws 126 at the level au the joint 38. The claws 126 have been previously opened.

The claws 126 are then closed onto the top portion of the joint 38. It is to be noted that the inner sides 142 of the claws are shaped to complement the joint 38 therein so as to minimize damage to the joint 38, but still leaving an aperture 144 therebetween to insert the needle 93 (see FIG. 3C).

The actuator 134 is then operated to raise the gripper 96, with the cannabis joint 38 therein, so that the needle 93 is fully inserted in the joint 38 through the aperture 144 (see FIG. 3D). During the insertion of the needle 93, the operation of the plunger 138 is synchronized with the descent of the needle 93 in the joint 38. This allows to better spread the cannabis oil in the joint 38.

Figure 3E:
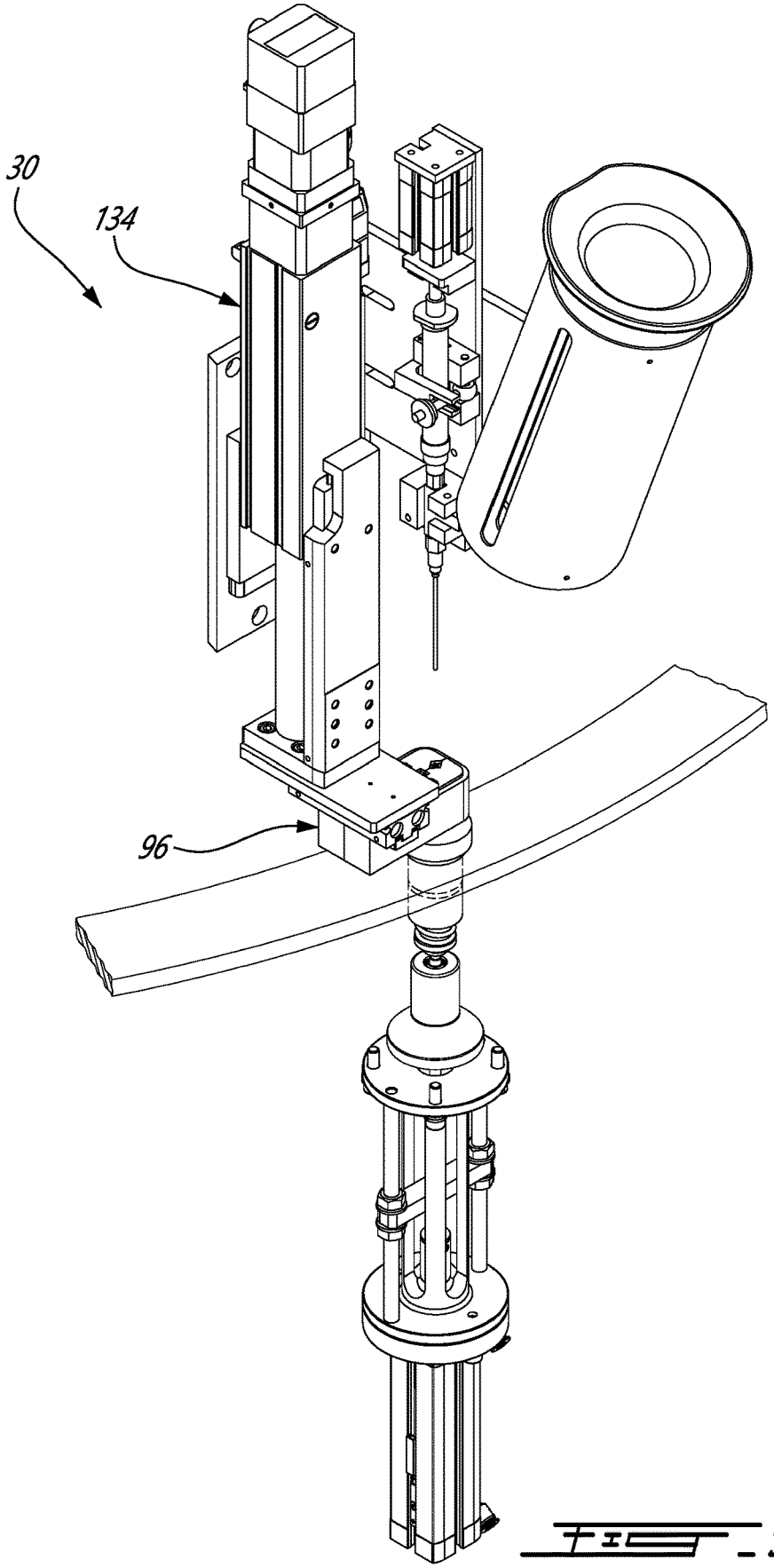
Figure 3F:
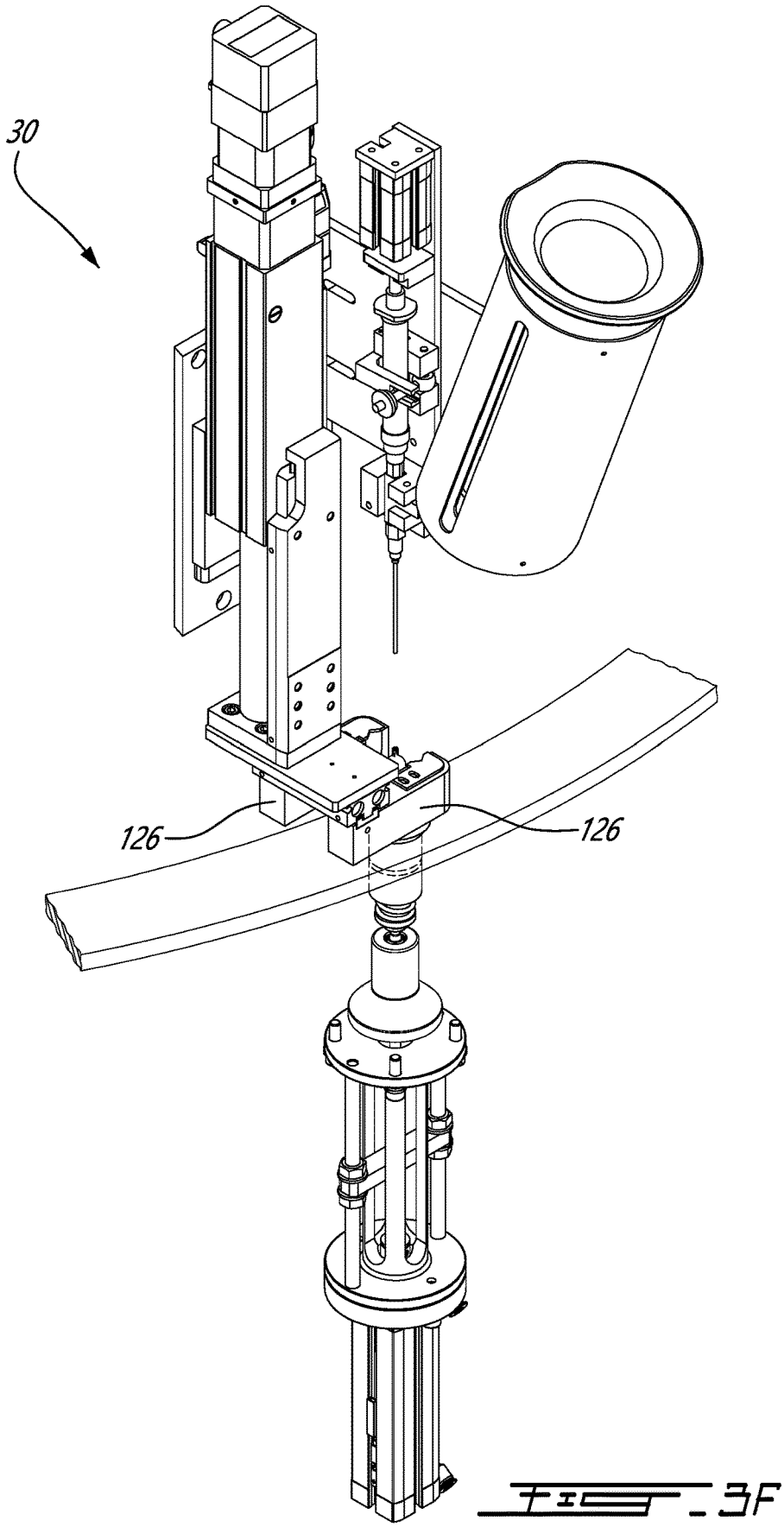
Figure 3G:
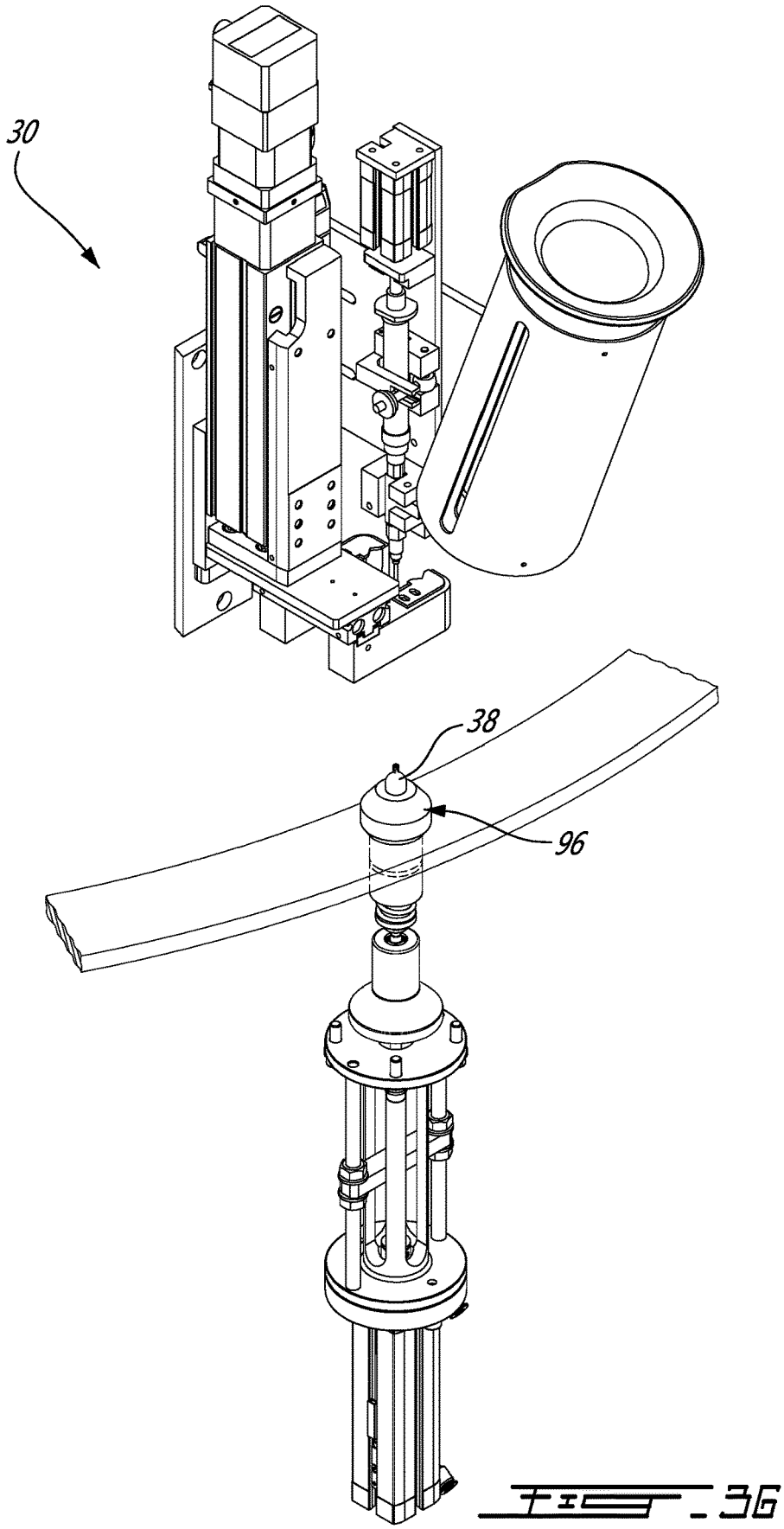

The actuator 134 is then operated to lower the gripper 96 to its lowest position (see FIG. 3E). The claws 126 are then opened (see FIG. 3F), releasing the final product 38 into the holder 16, ready to be moved to the next station 32 for the next step 220 in the process 200.

It is to be noted that the cannabis oil injector 30 is not limited to the illustrated embodiment. For example, the gripper 96 can be provided with another joint grabbing mechanism than the illustrated claws 126. The gripper 96 can also be configured so that the syringe 92 is moved towards the holder 16 instead of the joint 38 being raised towards the needle 93. The cone rising mechanism 78 can also be different or omitted.

The next station, the quality control and sorting system 32, comprises a cone rising mechanism 78, an electronic weighing scale 146 equipped with a joint receptacle thereon (not shown), for complementary receiving a joint 38 therein, a chute 148 provided with a pivotal gate (not shown) for sending the joints 38 in a selected one of two recipients (not shown) under the chute 148, depending on whether the end product 38 respond or not to predetermined criteria related to its weight, and first and second fingers assemblies 150 and 150'.

The first and second fingers assemblies 150 and 150' are movable in unison between first positions, wherein the first assembly 150 grabs the current cannabis joint 38 in the registered holder 16 while the second assembly 150' grabs a previously processed joint 38 on the scale 146, to second positions, wherein the first assembly 150 releases the current joint 38 on the scale 146 and the second assembly 150' releases the previously processed joint 38 in the chute 148. At the same time, the gate is operated so that the joint 38 falls in the correct recipient as mentioned hereinabove.

It is to be noted that the quality control and sorting system 32 can further or alternatively be provided with other quality control device than a weighting scale 146, including without limitations a camera and/or another sensor.

Other mechanisms or devices than the finger assemblies 150 and 150' and chute 148 can be provided to move the final product 38 towards measuring equipment and out of the machine 10.

The following two stations 34 and 36 are not provided to further process the joint 38 but aim at preparing the holder 16 for a new joints manufacturing cycle (step 222).

The damaged cone ejector 34 is provided to eject any cone 37 still present in the cone holder 16 following detection of a damaged cone (not shown) by the cannabis filling system 22. Indeed, the cone filing system 22 is configured to detect whether a cone 37 to be filled is damaged, wherein, in such a case, all the following steps as described hereinabove are omitted for such a cone 37.

The damaged cone ejector 34 includes a cone-rising mechanism 78 (not visible) to raise the damaged cone, and a vacuum that forces the raised damaged cone into a dedicated recipient (not shown).

The cone holder cleaning system 36 comprises an air blower to remove any residue that would remain after the passage of the holder 16 at the previous stations.

According to another illustrative embodiment (not shown), the cleaning device used in station 36 is different than illustrated and described or omitted.

As will now become apparent to a person skilled in the art, according to the process 200 there is always six cones 37 or joint 38 processed simultaneously. Each of the stations 18-36 works continuously and the carrousel 14 is rotated one tenth or 36 degrees (considering that there are 10 stations) each time the longest one of the steps 206 to 222 is finished.

The machine 10 further includes a control panel 152, provided with a touch screen 154 allowing to monitor the operation of the machine 10 and modify the operating parameters. According to another embodiment (not shown), other input and output devices are used to control the machine. For example, the machine 10 can be provided with wired or wireless communications so as to be controllable and/or configurable via a remote controller, computer or device.

It is to be noted that all the actuators described hereinabove are connected to one or more controllers (not shown) so that their operations are triggered and synchronized thereby. All the connectors between such controller(s) and the actuators have been omitted in the drawings to alleviate the views.

While the actuators mentioned hereinabove and illustrated in the drawings are of the pneumatic type, they can also be of another type, including without limitations hydraulic or electric.

It is to be noted that many modifications could be made to the cannabis oil injector and cannabis joint manufacturing machine described hereinabove and illustrated in the appended drawings. For example:

- the number and functions of the stations may be different than illustrated;
- the configuration, size and number of the mounting elements may be different than illustrated;
- the assembly of components of the machine 10, using for example fasteners, brackets, or mounting assemblies, may be replaced by permanent assembly, using, for example welding.

Although a cannabis oil injector and a cannabis joint manufacturing machine have been described hereinabove by way of illustrated embodiments thereof, they can be modified. It is therefore to be understood that numerous modifications may be made to the illustrative embodiments and that the scope of the claims should not be limited by the preferred embodiment but should be given the broadest interpretation consistent with the description as a whole.

What is claimed is:

1. A cannabis joints manufacturing machine comprising:

a plurality of different cannabis joints manufacturing stations, each for performing on one cannabis cone at a time a step among a sequence of steps for manufacturing a cannabis joint; one of the cannabis joints manufacturing stations including a cannabis oil injector; the plurality of different cannabis joints manufacturing stations being positioned side-by-side according to the sequence of steps for manufacturing a cannabis joint; and a cannabis cone support for receiving a plurality of cannabis cones and for sequentially moving together the plurality of cannabis cones between each of the plurality of different cannabis joints manufacturing stations; characterized in that the cannabis oil injector includes:

a syringe provided with an injection needle;

a cannabis oil reservoir that is connected to the syringe and that is configured to feed a predetermined single dose of cannabis oil thereto; and a gripper configured for taking the cannabis joint when it is received in the cone support, moving the cannabis joint so that it is penetrated by the injection needle, and moving back the cannabis joint into the cone support.

2. The cannabis joints manufacturing machine as recited in claim 1, further comprising a table for mounting the plurality of different cannabis joints manufacturing stations and the cannabis cone support thereto.

3. The cannabis joints manufacturing machine as recited in claim 2, wherein the table is mobile.

4. The cannabis joints manufacturing machine as recited in claim 1, wherein the cannabis cone support is a motorized carrousel including a plurality of cone holders, each for receiving one of the plurality of cannabis cones therein; the plurality of different cannabis joints manufacturing stations being positioned around the motorized carrousel.

5. The cannabis joints manufacturing machine as recited in claim 4, wherein each of the plurality of cone holders includes a bore that is shaped for complementary receiving the one of the plurality of paper cones therein.

6. The cannabis joints manufacturing machine as recited in claim 4, wherein the carrousel includes a plurality of holes therein, each for freely receiving a respective one of the plurality of cone holders therein; each of the plurality of cone holders includes a narrow elongated section for smooth translation in and out of the respective one of the plurality of holes of the carrousel, and a wider top portion for stably seating the cone holder in the respective hole.

7. The cannabis joints manufacturing machine as recited in claim 4, wherein the plurality of different cannabis joints manufacturing stations includes at least one of:

i) a paper cone distributor for distributing in sequence each of the plurality of cannabis cones in a cone holder;
ii) a cone positioner for operatively positioning the plurality of cannabis cones in the cone holders, one at a time;
iii) a cannabis filling system for filling a dose of cannabis in each of the plurality of cannabis cones in the cone holders, one at a time;
iv) a cannabis compactor for compacting the dose of cannabis in the plurality of cannabis cones in the cone holder, one at a time;
v) a cannabis joint closure system for closing an open end of the plurality of cannabis cones in the cone holders, one at a time;
vi) a cannabis joint end former for forming the open end of the plurality of cannabis cones in the cone holders, one at a time, after the open end is closed, yielding a cannabis joint;
vii) a quality control and sorting system to a assess a characteristic of the cannabis joint and to send the cannabis joints in a selected one of a plurality of recipients according to the characteristic; and
viii) at least one cone holder cleaning system.

8. The cannabis joints manufacturing machine as recited in claim 7, comprising all of the plurality of different cannabis joints manufacturing stations listed in i) to ix).

9. The cannabis joints manufacturing machine as recited in claim 7, wherein the paper cone distributor includes a chute that is registered with the cone holder for moving said each of the plurality of cannabis cones into the cone holder, and a cone indexer for taking on a support and releasing into the chute said each of the plurality of cannabis cones.

10. The cannabis joints manufacturing machine as recited in claim 7, wherein the cannabis filling system includes a paper cone filling apparatus for filling a dose of cannabis in the paper cone in the cone holder, and a cannabis feeding system, that is in fluid communication with the paper cone filling apparatus, for receiving cannabis in bulk and for feeding the dose of cannabis to the paper cone filling apparatus.

11. The cannabis joints manufacturing machine as recited in claim 10, wherein the cannabis feeding system includes i) an electronic weighing scale, ii) a cannabis feeding apparatus, adjacent the weighing scale, for receiving the cannabis in bulk and for controllably outputting the cannabis onto the weighing scale, and a single portion cannabis distributing device including two cups that are sequentially movable between a cannabis weighing position, wherein one of the two cups cooperates with the weighing scale to measure the dose of cannabis, and a cannabis distributing position, where the dose of cannabis is fed to the paper cone filling apparatus.

12. The cannabis joints manufacturing machine as recited in claim 11, wherein the paper cone filling apparatus includes a funnel, positioned adjacent the single portion cannabis distributing device and registered with the cone holder, for receiving the dose of cannabis therefrom, and a reciprocating needle mechanism that includes a needle that is movable in said each of the plurality of cannabis cones in the cone holder to reciprocate therein while being moved out thereof the paper cone so as to pre-compact the dose of cannabis while it is filled therein.

13. The cannabis joints manufacturing machine as recited in claim 7, wherein the cannabis joint closure system includes a grabber for holding one of the plurality of cannabis cone, a cone-rising mechanism for raising the cannabis cone within reach of the grabber and a rotary gripper that rotates a top portion of the one of the plurality of cannabis cones to form a twisted tip therewith.

14. The cannabis joints manufacturing machine as recited in claim 12, wherein the cannabis joint closure system includes a cutter for cutting a portion of the twisted tip.

15. The cannabis joints manufacturing machine as recited in claim 7, wherein the cannabis joint closure system includes a pusher rod to flatten the open end of the plurality of cannabis cones in the cone holders, one at a time.

16. The cannabis joints manufacturing machine as recited in claim 7, wherein the quality control and sorting system includes a weighing scale to assess the weight of the cannabis joint.

17. The cannabis joints manufacturing machine as recited in claim 16, wherein the quality control and sorting system includes at least one joint moving device to move the cannabis joint between the cone holder, the weighting scale and one of the plurality of recipients.

18. The cannabis joints manufacturing machine as recited in claim 17, wherein the at least one joint moving device includes two joint moving devices for moving in unison the cannabis joint between the cone holder and the weighting scale and another cannabis joint between the weighing scale and said one of the plurality of recipients.

19. The cannabis joints manufacturing machine as recited in claim 7, wherein the at least one cone holder cleaning system includes an air blower.

20. The cannabis joints manufacturing machine as recited in claim 1, wherein the plurality of different cannabis joints manufacturing stations includes at least one of:

i) a paper cone distributor for distributing the plurality of cannabis cones;
ii) a cone positioner for shaping the plurality of cannabis cones, one at a time;
iii) a cannabis filling system for filling a dose of cannabis in each of the plurality of cannabis cones cone support, one at a time;
iv) a cannabis compactor for compacting cannabis in the plurality of cannabis cones, one at a time;
v) a cannabis joint closure system for closing an open end of the plurality of cannabis cones, one at a time;
vi) a cannabis joint end former for forming the open end of the plurality of cannabis cones, one at a time, after the open end is closed, yielding a cannabis joint; and
vii) a quality control and sorting system to a assess a characteristic of the cannabis joint and to send the cannabis joints in a selected one of a plurality of recipients according to the characteristic.

21. The cannabis joints manufacturing machine as recited in claim 20, comprising all of the plurality of different cannabis joints manufacturing stations listed in i) to viii).

22. A system for injecting cannabis oil in a cannabis joint, the system comprising:

a syringe provided with an injection needle;

a cannabis oil reservoir that is connected to the syringe and that is configured to feed a predetermined single dose of cannabis oil thereto;

a cannabis joint holder for receiving a cannabis joint;

a gripper for i) taking the cannabis joint when it is received in the cannabis joint holder, ii) moving the cannabis joint so that it is penetrated by the injection needle, and iii) moving back the cannabis joint into the cannabis joint holder.

23. The system as recited in claim 22, further comprising a cone-rising mechanism for moving the cannabis joint partially out of the cannabis joint holder within a reach of the gripper.

24. The system as recited in claim 23, wherein the cone-rising mechanism includes a linear actuator, and a rod operatively coupled to the linear actuator.

25. The system as recited in claim 22, wherein the gripper comprises a linear actuator and a pair of claws that are mounted to the linear actuator so as to be movable towards and away each other; the linear actuator being for moving the pair of claws towards and away the cannabis joint.

26. The system as recited in claim 22, wherein the syringe including a plunger and a linear actuator for moving the plunger.

27. A process for manufacturing cannabis joints, the process comprising:

providing a carrousel having a plurality of sectors and a plurality of paper cone holders, one in each of the plurality of sectors;

providing a series of processing stations positioned around the carrousel, each of the processing stations corresponding to a distinct step among a sequence of steps for manufacturing a cannabis joint;

performing the sequence of steps for each of the plurality of paper cone holders after rotating the carrousel to move the plurality of paper cone holders along the series of processing stations positioned around the carrousel;

wherein the sequence of steps includes injecting cannabis oil in the cannabis joint, characterized in that the step of injecting cannabis oil in the cannabis joint includes i) a gripper taking the cannabis joint in one of the plurality of paper cone holders, moving the cannabis joint so that it is penetrated by an injection needle, and moving back the cannabis joint into said one of the plurality of paper cone holders.

28. The process as recited in claim 27, wherein the sequence of steps includes:

a) inserting a paper cone in one of the cone holders;

b) positioning the paper cone in said one of the paper cone holders;

c) filling a portion of cannabis into the paper cone;

d) compacting the portion of cannabis in the paper cone;

e) closing the paper cone;

f) forming the top of the paper cone, yielding a cannabis joint; and g) injecting cannabis oil in the cannabis joint, resulting in a final product.

29. The process as recited in claim 28, further comprising at least one of h) controlling the quality of the final product; and i) cleaning said one of the cone holders.

30. The process as recited in claim 29, wherein controlling the quality of the final product includes weighting the final product.

31. The process as recited in claim 28, wherein c) filling a portion of cannabis into the paper cone includes 1) receiving cannabis in bulk, 2) controllably outputting the cannabis in bulk onto a weighing scale for determining the portion of cannabis, and 3) feeding the portion of cannabis to the paper cone.

32. The process as recited in claim 31, further comprising simultaneously pre-compacting the portion of cannabis while said 3) feeding the portion of cannabis to the paper cone.

33. The process as recited in claim 28, wherein d) compacting the portion of cannabis in the paper cone includes reciprocating a rod into the paper cone.

34. The process as recited in claim 28, wherein e) closing the paper cone includes twisting an open end of the paper cone to yield a twisted tip of the paper cone.

35. The process as recited in claim 28, wherein f) forming the top of the paper cone includes cutting a portion of the twisted tip.

36. The process as recited in claim 28, wherein f) forming the top of the paper cone includes flattening the top of the paper cone.

37. The process as recited in claim 28, wherein the paper cone includes a filter.

* * * * *